US010518278B2

(12) United States Patent
Du Boisbaudry et al.

(10) Patent No.: US 10,518,278 B2
(45) Date of Patent: Dec. 31, 2019

(54) FLUID PRODUCT DISPENSING DEVICE

(71) Applicant: APTAR FRANCE SAS, Le Neubourg (FR)

(72) Inventors: Guillaume Du Boisbaudry, Bois Guillaume (FR); Philip Steer, Blackburn (GB)

(73) Assignee: APTAR FRANCE SAS, Le Neubourg (FR)

( * ) Notice: Subject to any disclaimer, the term of this patent is extended or adjusted under 35 U.S.C. 154(b) by 777 days.

(21) Appl. No.: 14/349,598

(22) PCT Filed: Oct. 2, 2012

(86) PCT No.: PCT/FR2012/052225
§ 371 (c)(1),
(2) Date: Apr. 3, 2014

(87) PCT Pub. No.: WO2013/050693
PCT Pub. Date: Apr. 11, 2013

(65) Prior Publication Data

US 2014/0231466 A1 Aug. 21, 2014

(30) Foreign Application Priority Data

Oct. 5, 2011 (FR) ..... 11 58971

(51) Int. Cl.
*B05B 11/00* (2006.01)
*B65D 83/38* (2006.01)

(52) U.S. Cl.
CPC ..... *B05B 11/0005* (2013.01); *B65D 83/38* (2013.01)

(58) Field of Classification Search
CPC ..... B65D 83/38; B65D 83/40
(Continued)

(56) References Cited

U.S. PATENT DOCUMENTS 3,083,854 A 4/1963 Lusher
3,189,207 A * 6/1965 Heyne et al. ..... 215/12.2
(Continued)

FOREIGN PATENT DOCUMENTS

DE 29 06 308 A1 8/1980
EP 0 252 370 A1 1/1988
(Continued)

OTHER PUBLICATIONS

International Search Report for PCT/FR2012/052225 dated Dec. 18, 2012.

(Continued)

*Primary Examiner* — Patrick M. Buechner
*Assistant Examiner* — Michael J. Melaragno
(74) *Attorney, Agent, or Firm* — Sughrue Mion, PLLC

(57) ABSTRACT

A fluid dispenser device having a dispenser member mounted on the neck of a container, with a neck gasket interposed. The dispenser member is mounted by a fastener element having a fastener portion and a compression portion. The compression portion includes a projecting profile that exerts stresses on the neck gasket. After assembly, the neck of the container generates first stresses in the neck gasket, and the projecting profile of the fastener element generates second stresses in the neck gasket, the first stresses approximately axially opposite the second stresses. The neck includes a top curved margin and defines an edge in contact with the neck gasket, the first and second stresses approximately axially opposite but radially offset, such that said first and second stresses are balanced at least in part.

11 Claims, 1 Drawing Sheet

(58) Field of Classification Search
USPC ..... 222/402.1
See application file for complete search history.

(56) References Cited

U.S. PATENT DOCUMENTS

| | | | | |
|---|---|---|---|---|
| 3,949,912 | A * | 4/1976 | Meshberg et al. | 222/394 |
| 3,986,248 | A * | 10/1976 | Meshberg et al. | 29/458 |
| 5,199,615 | A * | 4/1993 | Downing et al. | 222/397 |
| 5,234,137 | A * | 8/1993 | Meuresch et al. | 222/402.1 |
| 5,406,689 | A * | 4/1995 | Radtke | 29/527.1 |
| 6,131,777 | A * | 10/2000 | Warby | 222/402.2 |
| 6,179,169 | B1 * | 1/2001 | Radtke | 222/402.1 |
| 6,332,563 | B2 * | 12/2001 | Baudin | 222/386.5 |
| 6,343,722 | B1 * | 2/2002 | Di Giovanni | 222/402.1 |
| 6,401,979 | B1 * | 6/2002 | Mekata et al. | 222/105 |
| 6,772,913 | B2 * | 8/2004 | Garcia et al. | 222/153.09 |
| 8,286,840 | B2 * | 10/2012 | Jacuk | 222/402.2 |
| 8,746,512 | B2 * | 6/2014 | Miyamoto et al. | 222/394 |
| 2003/0192917 | A1 * | 10/2003 | Eames et al. | 222/402.1 |
| 2008/0006657 | A1 * | 1/2008 | Griemla | 222/402.1 |
| 2008/0011291 | A1 * | 1/2008 | Fletcher et al. | 128/200.14 |
| 2012/0241457 | A1 * | 9/2012 | Hallman et al. | 220/309.1 |

FOREIGN PATENT DOCUMENTS

| | | | |
|---|---|---|---|
| FR | 2 775 263 | A1 | 8/1999 |
| JP | 2004-99180 | A | 4/2004 |

OTHER PUBLICATIONS

English translation of the International Preliminary Report on Patentability for PCT/FR2012/052225.

* cited by examiner

FLUID PRODUCT DISPENSING DEVICE

CROSS REFERENCE TO RELATED APPLICATIONS

This application is a National Stage of International Application No. PCT/FR2012/052225 filed Oct. 2, 2012, claiming priority based on French patent application No. 1158971 filed Oct. 5, 2011, the contents of all of which are incorporated herein by reference in their entirety.

The present invention relates to a fluid dispenser device including a fastener element for fastening a dispenser member on the neck of a container. More particularly, the present invention relates to a fastener cap for fastening a metering valve on the neck of a container, with a neck gasket interposed therebetween so as to provide sealing at the neck of the container.

It is common practice to use a fastener element for fastening a pump or a valve on the neck of a container. A typical fastener element generally comprises a reception portion for receiving the dispenser member in stationary manner, a fastener portion for fastening to the neck of said container, and an "intermediate" portion that, once the fastener element has been put into place, guarantees that the neck gasket is compressed against the top margin of the neck of the container so as to guarantee sealing. Such typical fastener elements, which may be screw-on or snap-on rings or crimp-on caps, present a certain number of drawbacks. In particular, for dispensers containing propellant gas, the top margin of the container generally defines a sharp edge. While assembling the fastener element, the neck gasket is clamped between that edge of the container and a flat of the fastener element, generally a crimping cap. Mechanically, this leads to very high stresses on the container, resulting in a risk of the gasket being cut, whereas the stresses remain small on the fastener-element, thereby generating a risk of leakage and thus of the neck gasket malfunctioning after assembly. Achieving a balance between risk of leakage and a risk of the gasket being cut makes the method of fastening a valve on a container by means of a cap very tricky, especially for industrial quantities. Documents U.S. Pat. No. 3,083,854, JP 2004/099180, EP 0 252 370, DE 29 06 308, and FR 2 775 263 describe prior-art devices.

An object of the present invention is to provide a fastener element that does not have the above-mentioned drawbacks.

In particular, an object of the present invention is to provide a fastener element that is simple and inexpensive to manufacture and to assemble.

Another object of the present invention is to provide such a fastener element that limits the risks of the neck gasket malfunctioning during assembly.

Another object of the present invention is to provide such a fastener element that allows manufacturing tolerances to be relatively large.

Another object of the present invention is to provide a fluid dispenser device that can be made and assembled at low cost, while guaranteeing good sealing.

The present invention thus provides a fluid dispenser device comprising: a dispenser member, such as a pump or a valve, mounted on the neck of a container containing a fluid to be dispensed, with a neck gasket interposed therebetween so as to provide sealing at said neck of the container, said dispenser member being mounted on said neck by means of a fastener element, comprising a fastener portion for fastening to said neck of the container and a compression portion for compressing said neck gasket against said neck of the container, said compression portion including at least one projecting profile adapted to exert stresses on said neck gasket after assembly, wherein, after assembly, said neck of the container generates first stresses in said neck gasket, and said at least one projecting profile of the fastener element generates second stresses in said neck gasket, said first stresses being approximately axially opposite said second stresses, said neck of the container including a top margin of curved shape, said neck defining, at its end, an edge that is in contact with said neck gasket, said at least one projecting profile being arranged radially on the outside or on the inside of said edge when the fastener element is assembled on the neck of the container, said first and second stresses being approximately axially opposite but being radially offset, such that said first and second stresses are balanced at least in part.

Advantageously, said compression portion includes a radial wall, said at least one projecting profile projecting axially from said radial wall towards said neck gasket.

Advantageously, said at least one projecting profile is a projecting bead that is continuous around said fastener element.

In a variant, the fastener element may include a plurality of projecting profiles that are distributed around said fastener element.

Advantageously, said at least one projecting profile is made by deforming material, in particular by stamping, or by adding material, in particular by heat sealing and/or by adhesive bonding.

Advantageously, said fastener portion includes crimping, snap-fastener, or screw-fastener means.

Advantageously, said fastener element includes a reception portion for receiving said dispenser member.

Advantageously, said at least one projecting profile increases the contact surface between the neck gasket and the neck of the container and/or increases the contact pressure between the neck gasket and the neck of the container and/or increases the contact pressure between the neck gasket and the fastener element.

Advantageously, the dispenser member is a metering valve, and the fastener element is a crimping cap, preferably metal, that is fastened to the neck by crimping.

These characteristics and advantages of the present invention, and others, appear more clearly from the following detailed description of a particular embodiment of the invention, given by way of non-limiting example, and with reference to the accompanying drawings, in which.

The description below is made with reference to a fastener element made in the form of a fastener cap for fastening a metering valve on a neck of a container containing a fluid and a propellant gas, in particular a hexafluoroacetone (HFA) gas, but naturally the present invention applies to any type of fastener element (ring or cap) for fastening any dispenser member (pump, metering valve, or non-metering valve) on a neck of a container containing any fluid (liquid, powder, or paste) with or without propellant gas.

Figure 1:
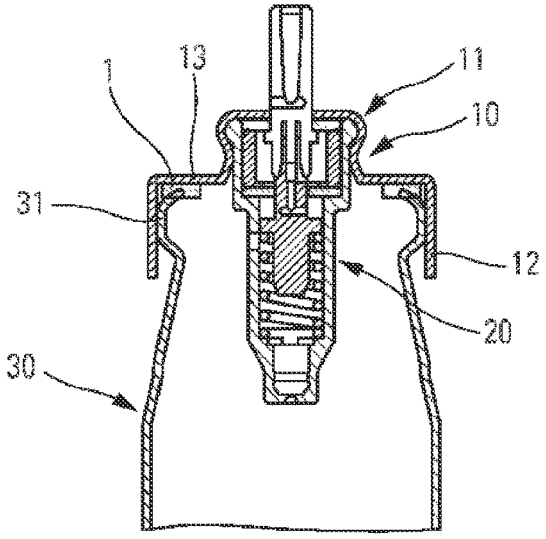
FIG. 1 is a diagrammatic section view of a fluid dispenser device with a fastener element made in accordance with the prior art.

With reference to FIG. 1, the dispenser device includes a dispenser member, such as a metering valve 20, that comes to be assembled on the neck 31 of a container 30 by means of a fastener element 10, in particular a crimping cap. The metering valve 20 may be of any type, and is therefore not described is greater detail below. In particular, the metering valve may comprise a valve body in which a valve member slides. The valve body advantageously comes to be fastened in a reception portion 11 of the fastener element 10, which reception portion may be provided so as to receive and to hold the valve body in stationary manner, in particular by snap-fastening or by crimping. The fastener element 10 also includes a fastener portion 12 for fastening to said neck 31 of the container 30, said fastener portion 12 might include crimping, snap-fastener, or screw-fastener means, or any other known means. In the embodiment shown in FIG. 1, the means shown are crimping means. The fastener element 10 further includes a compression portion, preferably formed by a radial wall 13, that connects the reception portion 11 to the fastener portion 12, and that, after assembly, is for compressing the neck gasket 1 against the neck 31 of the container, so as to provide sealing at that location.

Figure 2:
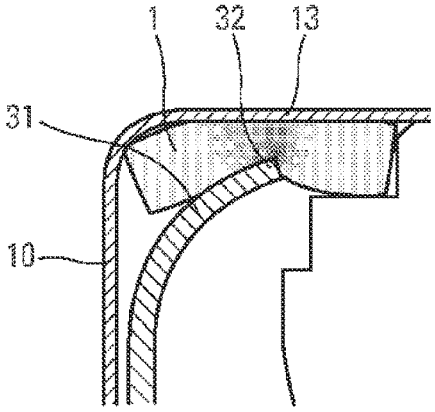
FIG. 2 is a diagrammatic section view showing, in detail, the stresses exerted by the neck of the container against the neck gasket after assembling the fastener element of the prior art.

FIGS. 1 and 2 show a conventional container neck 31 for devices containing a propellant gas, with the curve-shaped top margin defining, at its end, an edge 32 that is in contact with said neck gasket. This edge 32, which may be sharp, generates significant first stresses in the neck gasket during and after assembly, thereby causing a risk of the neck gasket 1 being cut. In contrast, the opposite edge of the neck gasket 1 is in contact with a plane radial wall 13 of the fastener element 10, thereby generating only a small amount of stress on the gasket, thereby generating a risk of leakage. In order to avoid the risk of leakage, it is necessary to exert top pressure on the gasket at the radial wall 13, but then the gasket risks being cut by the edge 32 of the neck 31. If it is desired to avoid the risk of the neck gasket being cut by the edge 32, it is necessary to limit the bearing force of the fastener element 10 on the neck gasket, with consequent risks of leakage at the plane radial wall 13 of the cap. These two conflicting requirements are difficult to reconcile during assembly of the fastener element, in particular in industrial quantities, making the step of assembling the fastener element tricky.

In the invention, said compression portion, in particular the radial wall 13, of the fastener element 10 includes at least one projecting profile 17 adapted to exert second stresses in said neck gasket 1 after assembling the fastener element 10.

Preferably, said at least one projecting profile 17 projects axially from said radial wall 13 towards said neck gasket 1. Various variant embodiments are possible. Thus, said at least one projecting profile may be formed by a projecting bead that is continuous all around said radial wall 13 of said fastener element 10. In a variant, a plurality of projecting profiles distributed around said fastener element may also be envisaged.

After assembling the fastener element 10, said neck 31 of the container 30 generates first stresses in said neck gasket 1, and said at least one projecting profile 17 of the fastener element 10 generates second stresses in said neck gasket 1, said first stresses being approximately axially opposite said second stresses.

Figure 3:
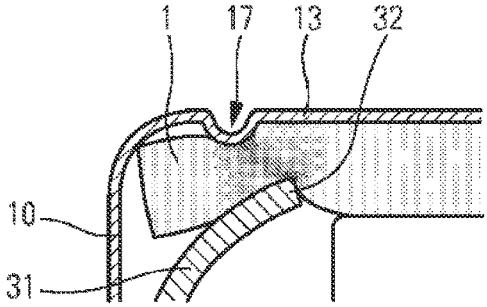
FIG. 3 is a view similar to the view in FIG. 2, with a fastener element made in accordance with an advantageous embodiment of the present invention.

Dispenser devices, in particular those containing a propellant gas, typically include a container having a neck 31 that includes a top margin of curved shape that generally defines, at its end, an edge 32 that is in contact with said neck gasket, as shown in FIGS. 1 to 3. As explained above, that configuration presents a risk of the neck gasket being cut during assembly. With the present invention, the risk is greatly reduced, or even eliminated.

Said at least one projecting profile 17 is arranged radially on the outside of the top margin of the neck 31, in particular of said edge 32, when the fastener element 10 is assembled, said first and second stresses thus being approximately axially opposite but radially offset, such that said first and second stresses are balanced at least in part, greatly reducing, even eliminating, the risk of the gasket being cut. This balancing is shown diagrammatically in FIG. 3. Furthermore, said at least one projecting profile 17 advantageously increases the areas of contact between the neck gasket 1 and the neck 31 of the container 30, pushing said neck gasket 1 against said neck 31. The presence of said at least one projecting profile 17 also increases the contact pressure firstly between the neck gasket 1 and the neck 31 of the container 30, and secondly between the neck gasket 1 and the fastener element 10, substantially improving sealing of the assembly. The present invention also allows for much better manufacturing and assembly tolerances, making the step of assembling the fastener element 10 much less tricky to control from an industrial point of view. Thus, with curved container necks as shown in the figures, in the event of too high a pressure during crimping, it is not the neck gasket that is cut, but rather the neck of the container that is able to deform, without risk of loss of sealing. It should be observed that in a variant, the projecting profile(s) 17 could also be arranged radially on the inside of the edge 32 of the neck 31.

Figure 4:
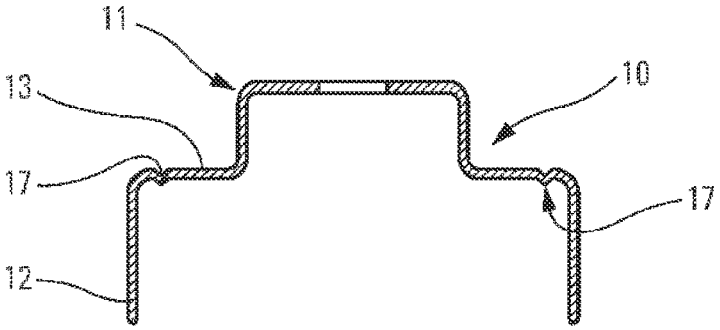
FIG. 4 is a diagrammatic section view of a fastener element in an advantageous embodiment of the present invention.

Manufacturing the fastener element 10 as shown in FIGS. 3 and 4 is particularly simple. Thus, for a metal cap, said metal cap may firstly be made in conventional manner with a plane radial wall 13, then the radial wall may be deformed, e.g. by deforming material such as by stamping, so as to form the projecting profile(s) 17. It is also possible to imagine keeping the outer surface of the radial wall 13 plane, and to form projecting profiles 17, e.g. ribs, only on the inner surface of the radial wall 13, in particular so as to avoid increasing the springiness of the cap. In a variant, said at least one projecting profile 17 may also be made by adding material, e.g. by heat sealing and/or by adhesive bonding. Other methods of making said at least one projecting profile can also be envisaged. For example, instead of being prefabricated in said fastener element 10 before assembly, said at least one projecting profile 17 could be made while assembling the fastener element 10 on the neck 31 of the reservoir 30.

Although the present invention is described above with reference to a particular embodiment, the description is naturally non-limiting, and any useful modification could be applied thereto by a person skilled in the art, without going beyond the ambit of the present invention, as defined by the accompanying claims.

The invention claimed is:

1. A fluid dispenser device comprising: a dispenser member, comprising a pump or a valve, mounted on a neck of a container containing a fluid to be dispensed, with a neck gasket interposed therebetween so as to provide sealing at said neck of the container, said dispenser member being mounted on said neck via a fastener element, comprising a fastener portion for fastening to said neck of the container, and a compression portion for compressing said neck gasket against said neck of the container, said compression portion including at least one projecting profile adapted to exert stresses on said neck gasket after assembly, wherein, after assembly, said neck of the container generates first stresses in said neck gasket, and said at least one projecting profile of the fastener element generates second stresses in said neck gasket, said first stresses being approximately axially opposite said second stresses, said neck of the container including a top margin of curved shape, said neck defining, at its end, an edge that is in contact with said neck gasket, the device being characterized in that said at least one projecting profile is arranged radially on the outside or on the inside of said edge when the fastener element is assembled on the neck of the container, said first and second stresses being approximately axially opposite but being radially offset, such that said first and second stresses are balanced at least in part.

2. The device according to claim 1, wherein said compression portion includes a radial wall, said at least one projecting profile projecting axially from said radial wall towards said neck gasket.

3. The device according to claim 1, wherein said at least one projecting profile is a projecting bead that is continuous around said fastener element.

4. The device according to claim 1, including a plurality of projecting profiles that are distributed around said fastener element.

5. The device according to claim 1, wherein said at least one projecting profile is made by deforming material, in particular by stamping, or by adding material, in particular by heat sealing and/or by adhesive bonding.

6. The device according to claim 1, wherein said fastener portion includes crimping, snap-fastener, or screw-fastener means.

7. The device according to claim 1, including a reception portion for receiving said dispenser member.

8. The device according to claim 1, wherein said at least one projecting profile increases the contact surface between the neck gasket and the neck of the container and/or increases the contact pressure between the neck gasket and the neck of the container and/or increases the contact pressure between the neck gasket and the fastener element.

9. The device according to claim 1, wherein the dispenser member is a metering valve, and the fastener element is a crimping cap, comprising metal, that is fastened to the neck by crimping.

10. A dispenser comprising:

a container having a neck at a first end of the container, the neck having an edge protruding from the container in an axial direction;

a fastener including a fastener portion configured to secure the fastener to the neck of the container;

a neck gasket provided between the edge of the neck and the fastener when the fastener is assembled on the container; and at least one projection provided on the fastener and positioned to extend in a direction toward the container when the fastener is assembled to the container, wherein the neck generates a first stress on the neck gasket when the fastener is assembled on the container, and the at least one projection generates a second stress on the neck gasket when the fastener is assembled on the container.

11. The dispenser according to claim 10, wherein the first stress and second stress are essentially opposing stresses in the axial direction.

* * * * *